US005746165A

United States Patent [19]

Speil et al.

[11] Patent Number: 5,746,165

[45] Date of Patent: May 5, 1998

[54] VALVE DRIVE OF AN INTERNAL COMBUSTION ENGINE

[75] Inventors: Walter Speil, Ingolstadt; Gerhard Maas, Herzogenaurach, both of Germany

[73] Assignee: Ina Walzlager Schaeffler KG, Germany

[21] Appl. No.: 849,007

[22] PCT Filed: Oct. 18, 1995

[86] PCT No.: PCT/EP95/04094

§ 371 Date: Apr. 29, 1997

§ 102(e) Date: Apr. 29, 1997

[87] PCT Pub. No.: WO96/15360

PCT Pub. Date: May 23, 1996

[30] Foreign Application Priority Data

Nov. 10, 1994 [DE] Germany ..... 44 40 133.7

[51] Int. Cl.[6] ..... F01L 1/14; F01L 13/00

[52] U.S. Cl. ..... 123/90.16; 123/90.17; 123/90.55

[58] Field of Search ..... 123/90.15, 90.16, 123/90.17, 90.48, 90.49, 90.52, 90.55, 90.6

[56] References Cited

U.S. PATENT DOCUMENTS

| | | | |
|---|---|---|---|
| 5,287,830 | 2/1994 | Dopson et al. | 123/90.16 |
| 5,343,833 | 9/1994 | Shirai | 123/90.16 |
| 5,603,294 | 2/1997 | Kawai | 123/90.16 |
| 5,651,335 | 7/1997 | Elendt et al. | 123/90.55 |

FOREIGN PATENT DOCUMENTS

| | | |
|---|---|---|
| 3543537 | 4/1986 | Germany . |
| 4202506 | 8/1992 | Germany . |
| 4213147 | 11/1992 | Germany . |
| 9306685 | 7/1993 | Germany . |
| 4206867 | 9/1993 | Germany . |
| 4206898 | 9/1993 | Germany . |
| 9315436 | 2/1994 | Germany . |
| 4-179810 | 6/1992 | Japan . |
| 93/22543 | 11/1993 | WIPO . |
| 94/21899 | 9/1994 | WIPO . |

*Primary Examiner*—Weilun Lo

*Attorney, Agent, or Firm*—Bierman, Muserlian and Lucas

[57] ABSTRACT

A cam follower (1) comprises an annular and a circular bottom portion (2, 3). The two bottom portions (2, 3) are concentric to each other, and a low lift cam (4) is arranged opposite the circular bottom portion (3) while at least one high lift cam (5) is arranged opposite the annular bottom portion (2). The cams (4, 5) are arranged out-of-phase with each other in circumferential direction. Since, therefore, when the cam follower (1) is coupled to the high lift cam (5), the low lift cam (4) would disadvantageously actuate the cam follower (1) with its excess lift, a means is provided in the cam follower for compensating this undesired lift.

10 Claims, 3 Drawing Sheets

VALVE DRIVE OF AN INTERNAL COMBUSTION ENGINE

The invention concerns a valve drive of an internal combustion engine wherein the cams contact at least one cam follower (1), at least one high lift cam (5) and one low lift cam (4) situated next to the high lift cam (5) in axial direction of the camshaft and being arranged out-of-phase with each other, said cams (4, 5) actuating the cam follower (1) in opening and closing directions of a gas exchange valve (51), the cam follower (1) being comprised of at least a first and a second unit (3, 2) which are displaceable relative to each other, the low lift cam (4) being in contact with the first unit (3) and the high lift cam (5) being in contact with the second unit (2).

A valve drive of the aforesaid type known from DE-42 02 506, comprises a cam follower having an annular bottom portion and a circular bottom portion concentric thereto. A low lift cam actuates the circular bottom portion, while the annular bottom portion is actuated by a cam of higher lift arranged on each side of the low lift cam in camshaft direction. The two bottom portions can be coupled to each other by hydraulic coupling means to achieve a maximum stroke of the tappet. As viewed in camshaft direction, the contour of the low lift cam is situated entirely within the projected contour of the high lift cam but slightly out-of-phase therewith. However, to obtain a more optimum filling of fuel-air mixture, it is advantageous, at a certain speed and loading of the internal combustion engine not only to lay the valve opening time point of the low lift cam in advance of the valve opening time point of the high lift cam but also to shift the lift of the low lift cam partially out of the lift of the high lift cam. At the same time, the hydraulic coupling of the units known from the generic prior art document proves to be unfavorable due to its compressibility arising from leakage losses, oil foaming and the like.

It is therefore an object of the invention to create a valve drive comprising at least one cam follower of the initially described species in which the mentioned drawbacks are eliminated, and in which, more particularly, a shifting of the valve opening time point of the low lift cam is achieved without influencing the valve opening time point of the high lift cam by simple means, and a reliable coupling of the two units of the cam follower is assured.

By virtue of the displaceble piston, the excess lift of the low lift cam is neutralized by a simple axial movement as long as the cam follower is coupled to the high lift cam. Because of said piston, which can also be locked in place for coupling the cam follower to the low lift cam, the load reversal potential of the cam follower can be exploited more optimally than in the cited prior art. Thus, it is no problem to advance the timing point of opening of the gas exchange valve when the engine is running at low speed and low load. However, a configuration, not specified here, is also conceivable with which, by an appropriate arrangement of the cams, the valve opening time point of the low lift cam lags behind that of the high lift cam.

In an advantageous embodiment of the invention, the cam follower is configured as a tappet.

Due to the fact that, in this preferred embodiment, the circular bottom portion protrudes beyond the annular bottom portion during the base circle phase of the control cams and in the coupled state of the elements, it is possible to configure the low lift cam so that it does not protrude beyond the outer contour of the high lift cam as viewed in camshaft direction although its lift is in excess of the lift of the high lift cam. However, a further embodiment, in which the two bottom portions are flush with one another during the base circle phase of the control cams, is both conceivable and intended. In such an embodiment, it is possible as set forth initially, to have the tip of the low lift cam protrude beyond the outer contour of the high lift cam as viewed in an axial direction of the camshaft.

Further developments of the invention are directed to the arrangement of the coupling elements within the cam follower. A coupling of the two units of the cam follower is effected by the force of a compression spring, while their uncoupling for switching over to the low lift cam is achieved by hydraulic medium pressure. The advantage of this variant is, for example, that an opening of the gas exchange valves is assured even in the absence of effective hydraulic pressure and an emergency schedule can be run (s. DE-GM 93 15 436.4). In place of the compression and tension springs used for the pistons in the present case, it is possible to use other pressurizing media such as, for example, magnetic, electromagnetic or further mechanical means. It is additionally conceivable to load the pistons on both sides with hydraulic medium. Further, a separate bush for receiving the piston can also be dispensed with i.e., the piston can also extend directly in a bore of the annular bottom portion. In this case, however, a stop for the central piston in the guide sleeve must be implemented by other means. At the same time, other means would then also be required for preventing a rotation of the central piston because, in the present case, this is assured by the end surface of the bush. The cam-proximal step in the central piston prevents a loss of the piston while, at the same time, assuring an internal self-contained flux of force for a compression spring, not described here, arranged around the guide bush. The displaceabilty of the central piston relative to the guide bush must correspond at least to the amount by which the lift of the low lift cam exceeds that of the high lift cam.

At least one through-bore is arranged in the bottom of the bush of the annular bottom portion. This through-bore facilitates the axial movement of the coupling element in the annular bottom portion by preventing it from getting disadvantageously "pumped up".

A stop element for the first piston serving as coupling element is arranged at the same time in the bore of the central piston. This stop element is a simple means for limiting the displacement of the first piston serving as coupling element.

The invention further provides for the bores in the central piston for the first and the further piston to be arranged at about 90° to each other. If necessary, it is also conceivable to arrange the bores for the first and the further piston diametrically opposite each other.

Advantageously, the cam follower can further comprise a hydraulic clearance compensation element. This hydraulic clearance compensation element and the pistons for coupling the bottom portions can be supplied with hydraulic medium through a common duct starting from the skirt of the annular bottom portion. It is, however, both conceivable and intended to have separate ducts for the pistons and the clearance compensation element starting from separate supply bores in the skirt. This latter variant would have the advantage that the clearance compensation element would be filled independently of the pressure required for switching the pistons, and, at initial or renewed ignition of the internal combustion engine, a reservoir of the clearance compensation element would be filled with hydraulic medium in the shortest possible time.

Although the invention is preferably directed to valve drives of internal combustion engines, it is also conceivable to use it in other cam-controlled drives in which a switching between cam profilies arranged offset to each other would be of advantage.

The invention is not limited to the features recited in the claims. Rather, combinations of individual features of the claims with each other and with the disclosures contained in the discussion of advantages and in the description of the embodiment of the invention are both conceivable and intended.

Coming now to the drawings:

FIG. 1*a* is a longitudinal cross-section through a cam follower of the invention;

FIG. 1*b* is a schematic cross-sectional representation showing the line along which the section of FIG. 1*a* is taken;

Figure 1A:
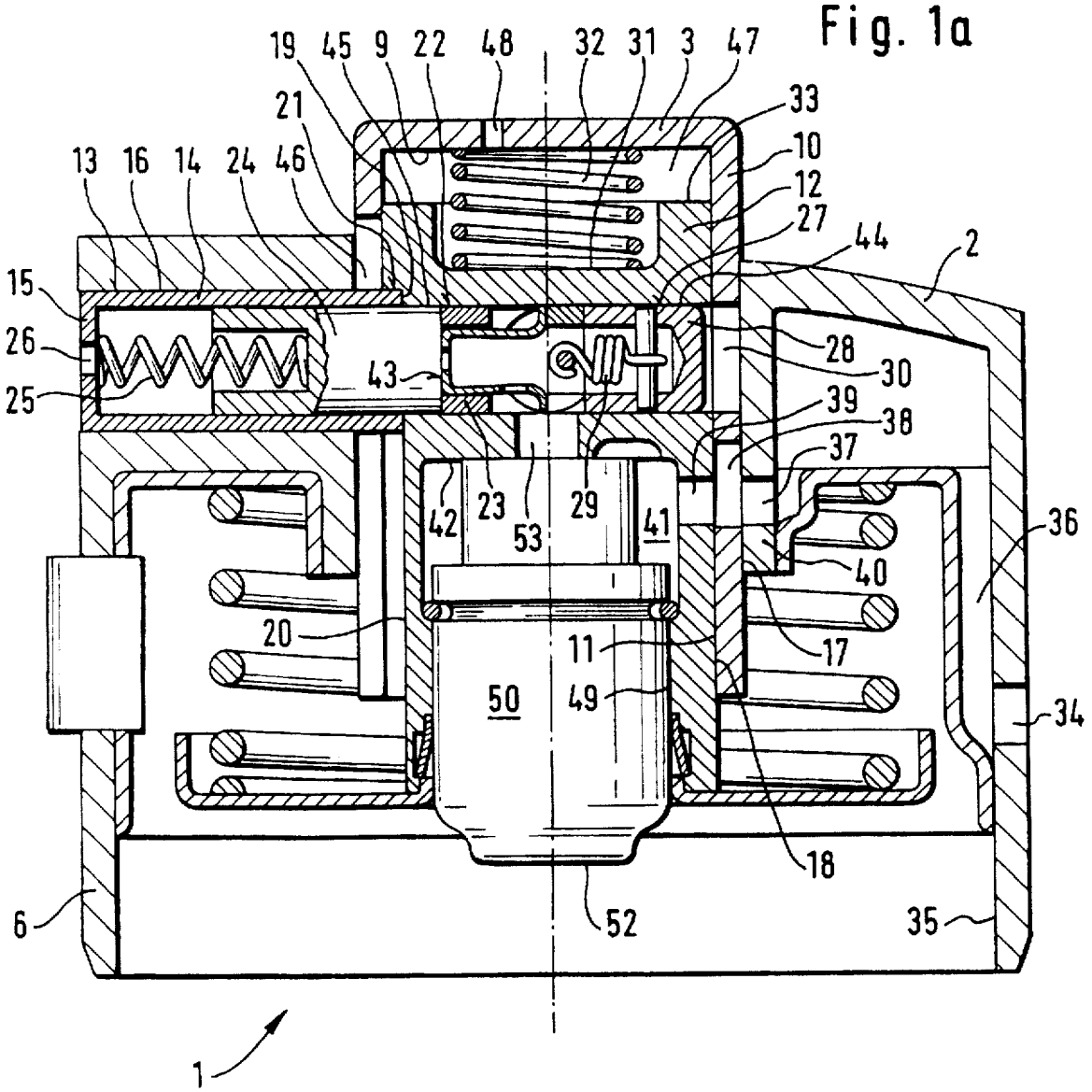
Figure 1B:
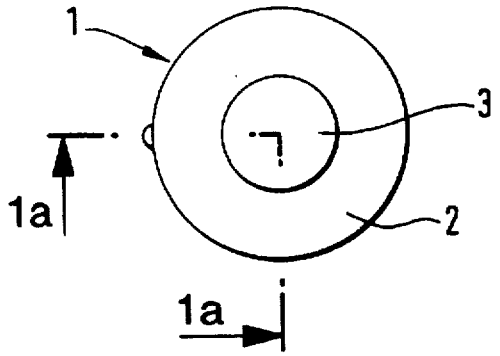
Figure 2:
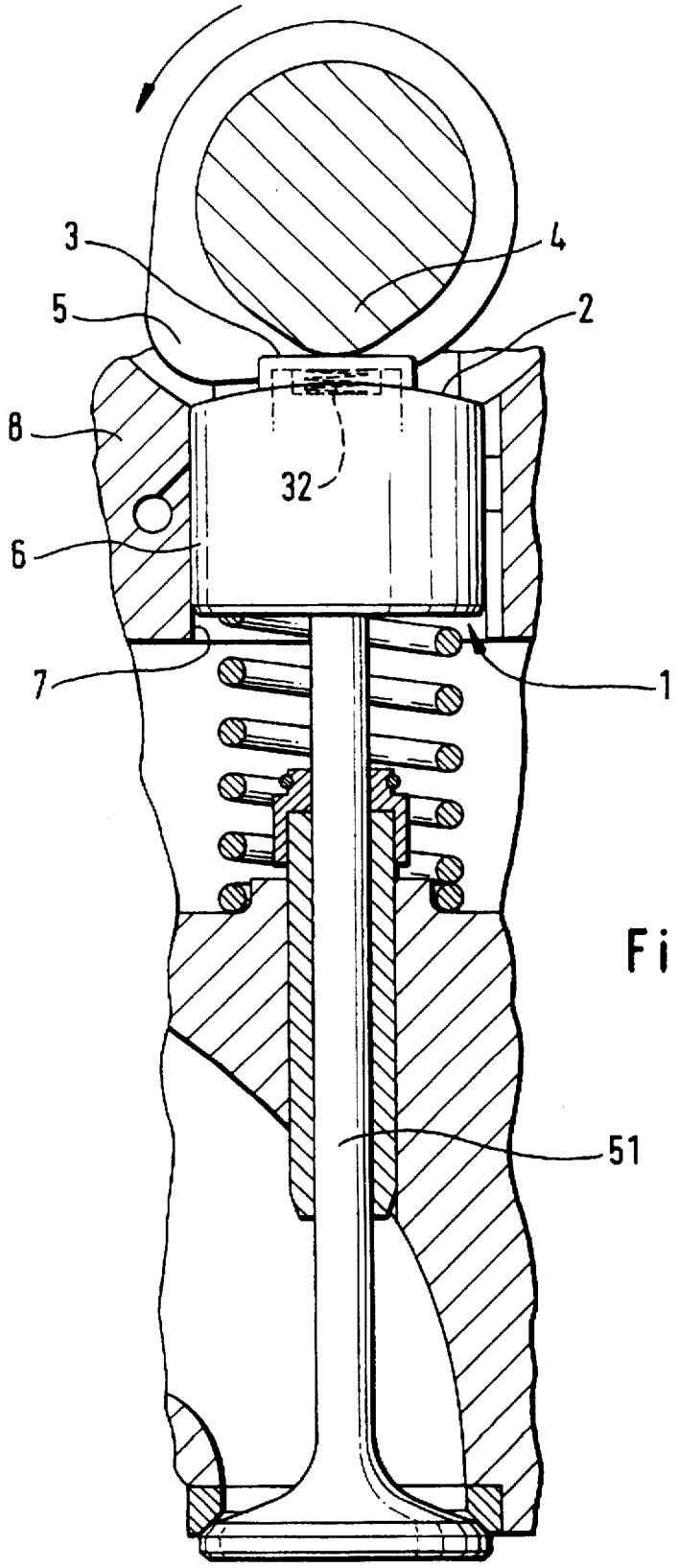
FIG. 2 is a general view of a valve drive comprising a cam follower of the invention.

FIG. 1*a* shows a cam follower 1 comprising an annular bottom portion 2 and a circular bottom portion 3. The bottom portions 2, 3 are arranged concentric and relatively displaceable to each other. A low lift cam 4 serves to load the circular bottom portion 3, and at least one high lift cam 5 is arranged behind the low lift cam 4 in camshaft direction for loading the annular bottom portion 2 (see also FIG. 2).

The tappet 1 is guided for axial displacaement in a bore 7 of a cylinder head 8 by a skirt 6 connected to the annular bottom portion 2. On its end surface 9 remote from the cams 4, 5, the circular bottom portion 3 comprises a hollow cylindrical guide bush 10 in whose bore 11 a central piston 12 is slidably arranged. At the same time there is provided a radial bore 1 3 in the annular bottom portion 2 in which a thin-walled bush 14 is fixed. The bottom 15 of this bush 14 delimits the bore 13 radially outwardly.

The outer peripheral surface 16 of the bush 14 simultaneously overlaps annular surfaces 17, 18 between the annular bottom portion 2 and the guide bush 10 and between the guide bush 10 and the central piston 12 respectively. To prevent the central piston 12 from rotating, the inner end surface 19 of the bush 14 bears against a flattened portion 20 of the central piston 12. The central piston 12 is at the same time fixed relative to the guide bush 14 in axial direction by a cam-proximal step 21.

The central piston 12 further comprises a radial bore 22 which, in the base circle phase of the cams 4, 5, is aligned to the radial bore 1 3 of the annular bottom portion 2. In the radial bore 22, there is arranged radially inwards a stop element 23 for a piston 24 extending in the radial bore 13 of the annular bottom portion 2 and serving as a coupling element. The piston 24 is biased radially inwards by the force of a compression spring 25 which is supported radially outwardly on the bottom 15 of the bush 14. The bush 14 at the same time comprises a through-bore 26 which prevents the formation of an unnecessary air cushion between the piston 24 and the bottom 15 of the bush 14. The bush 14 further permits the escape of excess hydraulic medium.

A further radial bore 27 in which a further piston 28 is arranged extends in the central piston 12 at right angles to the radial bore 22. This piston 28 is retained in the radial bore 27 against the hydraulic medium pressure by at least one tension spring 29. At the same time, a bore 30 of the guide bush 10 is aligned to the bore 27 in the base circle phase of the low lift cam 4.

A compression spring 32 is arranged on a cam-proximal end surface 31 of the central piston 12 and is supported at its other end on the end surface 9 of the circular bottom portion 3. The outer end surface 33 of the central piston 12 is arranged at a defined distance, which will be specified later, from the end surface 9 of the circular bottom portion 3.

Because, as initially stated, the low lift cam 4 is arranged out-of-phase with the high lift cam 5 i.e. its tip is in advance of the high lift cam 5, the low lift cam 4 could have an undesired influence on the lift of the gas exchange valve when the cam follower is coupled to the high lift cam 5. For obtaining a coupling of the cam follower 1 to the low lift cam 4, hydraulic medium is transferred through a supply bore 34 of the skirt 6 of the annular bottom portion 2, through an axially extending channel 36 on the inner peripheral surface 35 of the skirt 6, through a radial passage 37, 38, 39 which extends through an axial extension 40 of the annular bottom portion 2 and through the guide bush 10 and the central piston 12 to a central reservoir 41 and, from there, through a transfer opening 53 of a cam-remote end surface 42 of the central piston 12, to a point directly in front of an inner end surface 43 of the piston 24. The piston 24 is thus pushed radially outwards into the bush 14 till its inner end surface 43 becomes aligned to the inner end surface of the bush 14. At the same time, the hydraulic medium pressure pushes the further piston 28 radially outwards into the bore 30 of the guide sleeve 10 so that the outer peripheral surface 44 of the further piston 28 overlaps the annular surface 18. In this way, a positive engagement is established between the guide sleeve 10, the circular bottom portion 3 and the central piston 12. The cam follower 1 now follows the contour of the low lift cam 4. In this state, the annular bottom portion 2, together with its other components, executes a zero lift in accordance to the high lift cam 5.

For coupling the cam follower 1 to the high lift cam 5, decreasing hydraulic pressure causes the first piston 24 to move with a part of its outer peripheral surface 45 into the radial bore 22 of the central piston 12. Simultaneously with this, the piston 28 is pulled entirely into its radial bore 27 in the central piston 12 by the tension spring 29. In the region of the piston 24 and its bush 14, the guide bush 10 comprises an axially extending recess 46 whose length corresponds at least to the excess lift of the low lift cam 4 relative to the high lift cam 5. At the same time, the central piston 12 is configured so that its outer end surface 33 is spaced from the cam-remote end surface 9 of the circular bottom portion 3 by a distance corresponding at least to the excess lift of the low lift cam 4 just specified. By this arrangement, a simple coupling of the cam follower 1 to the high lift cam 5 is realized through the annular bottom portion 2. At the same time, due to the recess 46, an axial displaceability of the guide bush 10 together with the circular bottom portion 3 relative to the central piston 12 is established. For this state of coupling, the compression spring 32 holds the circular bottom portion 3 in constant contact with the cam and the central piston 12 abutted against the bush 14.

To avoid an unnecessary "pumping up" of the space 47 between the circular bottom portion 3 and the central piston 12, a deaeration bore 48 is provided in the circular bottom portion 3.

As can also be seen in FIG. 1*a* which has just been described, a hydraulic clearance compensation element 50, not described in detail, is arranged in a bore 49 of the central piston 12. The clearance compensation element 50 is connected for oil supply to the central reservoir 41 which, however, may also be integrated in the clearance compensation element 50.

Figure 3:
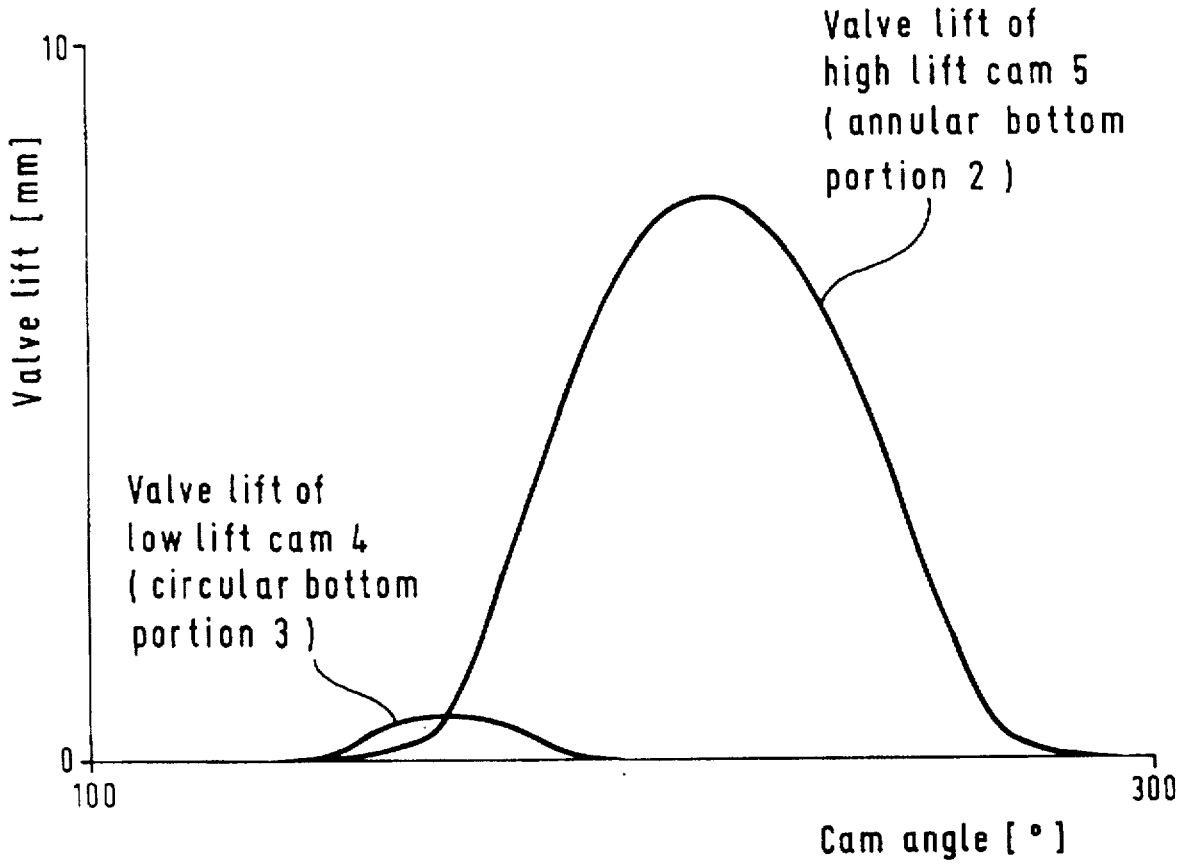
FIG. 3 is a graphical representation of the valve lifts of the bottom portions corresponding to the shifted phases of the cams.

Finally, FIG. 3 shows the different valve lift curves obtained by a selective loading of the annular and the circular bottom portions 2, 3. It can be seen that the valve lift obtained by loading with the low lift cam 4 is situated partly outside the valve lift obtained by loading with the high lift cam 5.

The present cam follower 1 will not be described more closely herein because it is sufficiently well-known in the art.

We claim:

1. A valve drive of an internal combustion engine comprising cams (4, 5) fixed on a camshaft, which said cams contact at least one cam follower (1), at least one high lift cam (5) and one low lift cam (4) situated next to the high lift cam (5) in an axial direction of the camshaft and being arranged out-of-phase with each other, said cams (4, 5) actuating the cam follower (1) in opening and closing directions of a gas exchange valve (51), the cam follower (1) being comprised of at least a first and a second unit (3, 2) which are displaceable relative to each other, the low lift cam (4) being in contact with the first unit (3) and the high lift cam (5) being in contact with the second unit (2), characterized in that a part of a lift of the low lift cam (4) is in excess of a lift of the high lift cam (5)

an axially displaceable piston (12) is arranged in a bore (11) of the first unit (3), and said piston (12) actuates the gas exchange valve (51) at least indirectly, for coupling the cam follower (1) to the low lift cam (4), the first unit (3) is coupled to the piston (12) which actuates the gas exchange valve (51), by a coupling means being a further piston (28), while the second unit (2) is uncoupled from the first unit (3) and from the piston (12) which actuates the gas exchange valve (51), for coupling the cam follower (1) to the high lift cam (5), the first unit (3) is uncoupled from the piston (12) which actuates the gas exchange valve (51) and is axially displaceable relative to the said piston (12) through a distance corresponding at least to an amount by which the lift of the low lift cam (4) exceeds the lift of the high lift cam (5), while the second unit (2) is coupled by a coupling means (24) to the piston (12) which actuates the gas exchange valve (51).

2. A valve drive of claim 1 wherein a tip of the low lift cam (4) is shifted in phase in advance of the high lift cam (5) in a direction of loading the cam follower (1).

3. A valve drive of claim 1 wherein the cam follower (1) is made as a tappet whose first unit (3) is configured as a circular bottom portion and whose second unit (2) is configured as an annular bottom portion, and said bottom portions (3, 2) are concentric to each other, the low lift cam (4) being configurerd as a central cam to load the circular bottom portion (3), the tappet being guided in a bore (7) of a cylinder head (8) by a hollow cylindrical skirt (6) connected to the annular bottom portion (2), while a cam-distal end surface (9) of the circular bottom portion (3) receives a guide bush (10).

4. A valve drive of claim 3 wherein bores (22, 13) are provided in the circular bottom portion (3) and in the annular bottom portion (2) as well as in the guide bush (10) of the circular bottom portion (3), said bores (22, 13) are aligned to each other in a base circle phase of the cams (4, 5) and lodge at least one of said coupling means (24) in the form of a piston which is displaceable hydraulically or by spring force so that, to couple the tappet (1) to the high lift cam (5), an outer peripheral surface (45) of the coupling means (24) overlaps an axially extending annular surface (17) between the first and the second unit (3, 2), a compression spring (32) is arranged on a cam-proximal end surface (31) of the piston (12) which actuates the gas exchange valve (51), and a second end of the compression spring (32) is supported on the end surface (9) of the circular bottom portion, the coupling means (24) for coupling the cam follower (1) to the high lift cam (5) extends in the radial bore (1 3) of the annular bottom portion (2), and to achieve said coupling, the outer peripheral surface (45) of the coupling means (24) simultaneously overlaps annular surfaces (17, 18) between the annular bottom portion (2), the guide bush (10 and the piston (12) which actuates the gas exchange valve (51), to extend partially in the aligned bore (22) of the the piston (12) which actuates the gas exchange valve (51), the guide bush (10) comprises in a region of the coupling means (24), a longitudinally extending recess (46) corresponding in length at least to an eliminating displacement of the guide bush (10) relative to the piston (12) which actuates the gas exchange valve (51).

5. A valve drive of claim 4 wherein a) the coupling means (24) is displaceable by a force of a compression spring (25) to couple the tappet (1) to the high lift cam (5), the compression spring (25) being supported radially outwardly on a bottom (15) of a bush (14) which is fitted into the bore (13) of the annular bottom portion (2) and in whose bore the piston (24) extends, said bush (14) extends radially inwards beyond the annular surfaces (17, 18) between the second unit (2), the guide bush (10) and the piston (12) which actuates the gas exchange valve (51), while an end surface (19) of the bush (14) bears against a cam-distal flattened portion (20) of an outer peripheral surface of the piston (12) which actuates the gas exchange valve (51), and said piston (12) is supported in cam-remote direction on an outer peripheral surface (16) of the bush (14) near the end surface (19) of the bush (14) by a cam-proximal step (21), at the same time, the further piston (28) is retained radially inwards in a further radial bore (27) of the piston (12) which actuates the gas exchange valve (51), by a force of at least one tension spring (29) and does not protrude radially outwards beyond this radial bore (27), for coupling the tappet (1) to the low lift cam (4), the coupling means (24) is displaceable radially outwards by hydraulic medium into the bore of the bush (14) so that an inner end surface (43) of the coupling means (24) is at least aligned to the end surface (19) of the bush (14), while, at the same time, the further piston (28) is displaceable radially outwards by the hydraulic medium against the force of the tension spring (29) into a complementary reception bore (30) in the guide bush (10) so that an outer peripheral surface (44) of the further piston (28) overlaps the annular surface (18) between the piston (12) which actuates the gas exchange valve (51), and the guide bush (10).

6. A valve drive of claim 5 wherein at least one through-bore (26) is arranged in the bottom (15) of the bush (14) of the annular bottom portion (2).

7. A valve drive of claim 4 wherein a stop element (23) for the coupling means (24) is arranged in the radial bore (22) of the piston (12) which actuates the gas exhange valve (51).

8. A valve drive of claim 5 wherein the radial bores (22, 27) provided for the coupling means (24) and the further piston (28) in the piston (12) which actuates the gas exchange valve (51) are arranged offset to each other by approximately 90° in circumferential direction.

9. A valve drive of claim 3 wherein a hydraulic clearance compensation element (50) is arranged in a cam-distal bore (49) of the piston (12) which actuates the gas exchange valve (51), with a bottom (52) of the hydraulic clearance compensation element (50) directly facing the gas exchange valve (51).

10. A valve drive of claim 9 wherein a common supply of hydraulic medium is provided in the tappet (1) for the clearance compensation element (50) and the coupling means (24) as well as the further piston (28), said common supply starts from a supply bore (34) in the skirt (6) and is routed through an axially extending channel (36) on the inner peripheral surface (35) of the skirt (6), through a radial passage (37, 38, 39) extending through an axial extension (40) of the annular bottom portion (2) in which the guide bush (10) is received, and further through the guide bush (10) and through the piston (12) which actuates the gas exchange valve (51) and which is lodged in the guide bush (10), into a central reservoir (41) of the clearance compensation element (50) from which hydraulic medium is supplied to the coupling means (24) and the further piston (28) through a transfer opening (53) in an end surface (42) of the piston (12) which actuates the gas exchange valve (51).

* * * * *